United States Patent [19]

Reppert et al.

[11] 3,964,987

[45] June 22, 1976

[54] ELECTROPLATING APPARATUS

[75] Inventors: Merlyn R. Reppert, Torrance; Thomas M. Beckwith, Riverside, both of Calif.

[73] Assignee: W. R. Grace & Co., New York, N.Y.

[22] Filed: Oct. 4, 1974

[21] Appl. No.: 511,978

Related U.S. Application Data

[60] Continuation-in-part of Ser. No. 472,745, May 23, 1974, abandoned, which is a division of Ser. No. 420,109, Nov. 29, 1973, Pat. No. 3,874,054.

[52] U.S. Cl. ..... 204/194; 204/297 W; 204/DIG. 7

[51] Int. Cl.[2] ..... C25D 17/06; C25D 17/10

[58] Field of Search ..... 204/288, 289, 297 W, 204/297 R, 231, DIG. 7, 15, 194

[56] References Cited

UNITED STATES PATENTS

| | | | |
|---|---|---|---|
| 1,738,515 | 12/1929 | Belke | 204/288 |
| 2,348,915 | 5/1944 | Lundbye | 204/297 W |
| 2,372,567 | 3/1945 | Graham et al. | 204/DIG. 7 |
| 2,401,415 | 6/1946 | Duggan | 204/DIG. 7 |
| 3,437,578 | 4/1969 | Gibbs et al. | 204/DIG. 7 |

*Primary Examiner*—T. M. Tufariello
*Attorney, Agent, or Firm*—Kenneth E. Prince; William Kovensky

[57] ABSTRACT

The invention relates to a process for making a nickel/chromium plated automobile wheel comprising plated rim and plated center, including special electroplating procedures and apparatus; and the resulting wheel.

6 Claims, 25 Drawing Figures

ELECTROPLATING APPARATUS

Figure 1:
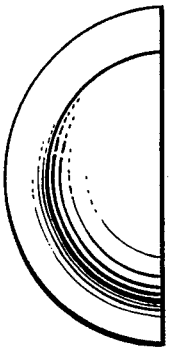

This application is a continuation-in-part of Ser. No. 472,745, filed May 23, 1974, now abandoned, which is in turn a division out of Ser. No. 420,109, filed Nov. 29, 1973, now U.S. Pat. 3,874,054.

This invention is directed to an improvement in the manufacture of automobile wheels, and more particularly concerns a method for forming the center of the wheel, together with electroplating same.

It is known to form an automobile wheel by stamping a center, followed by forming, polishing, plating, and welding the center into a plated rim. These wheel centers of the prior art, however, are relatively shallow, and offer no problems with regard to subsequent polishing steps to prepare the centers for electroplating. That is to say, all areas of these prior centers were accessible to polishing equipment. The same is not true for centers which have been subjected to deep drawing operations. By deep drawing is meant that the lug pockets are so deeply recessed that they are not accessible to conventional polishing machinery. As a matter of fact no prior processes have been available to make suitable deeply drawn wheel centers. By the process of this invention these and other problems have been solved. For example, for the first time, using the process of this invention it is possible to form a wheel center in which the lug pockets contain enough metal and are sufficiently strong to be punched to standard size lug holes. Also these wheel centers can be electroplated, using the process of this invention. Prior to this invention such deeply drawn lug pockets, even had they existed, could not have been suitably electroplated.

The instant wheel forming process is directed to the wheel center. Its ultimate attachment to the rim is conventional. To make a deeply drawn platable wheel center requires several crucial operations. The first of these operations requires that the strip stock be prepolished. (If it is not prepolished, even if the other steps are carried out, the resulting wheel center cannot be properly electroplated.) The second crucial operation is actually a series of operations carried out in a sequence of die presses. It is extremely important in this series of operations that the blank be initially very deeply drawn, i.e., forming a "hat" blank, with the depth of the draw being at least about one-quarter of the diameter of the blank, and the diameter of the draw being approximately five-sixths the diameter of the blank. This initial step gives sufficient depth of metal for the subsequent spoke forming steps and for lug pocket forming steps. If this deep draw is not made a weak lug pocket will result which will not have enough metal thickness to be stamped (i.e., pierced to form lug hole), or which may even crack during the forming processes. As a third crucial point the hub area, i.e., the center of the wheel center, must be reduced in height over several successive die forming operations. These three steps are part of the subject matter of the invention disclosed and claimed in Ser. No. 420,109, Reppert (sole).

Finally, as a fourth step, and part of the instant invention, in the electroplating step, we use a "collector" in association with the wheel center to insure that the lug pockets will be adequately plated. These steps constitute improvements over and above the standard and well known procedures of the prior art for making automobile wheels of the stamped and plated type. These steps are to be superimposed on the known conventional procedures.

Figure 1A:
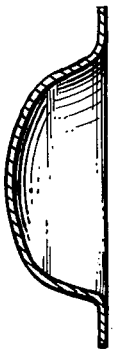
Figure 2:
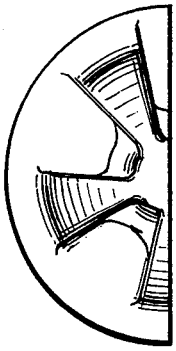
Figure 2A:
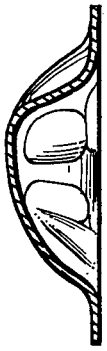
Figure 3:
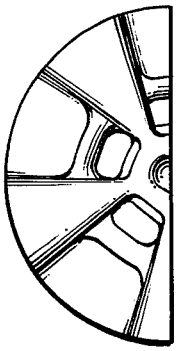
Figure 3A:
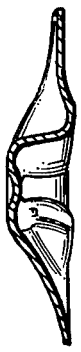
Figure 4:
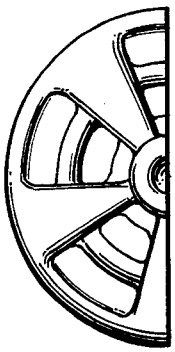
Figure 4A:
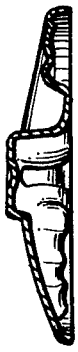
Figure 5:
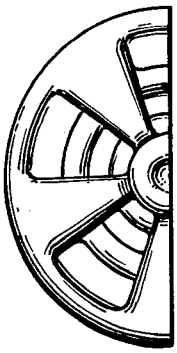
Figure 5A:
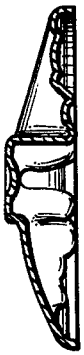
Figure 6:
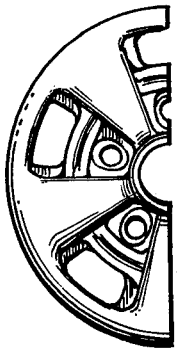
Figure 6A:
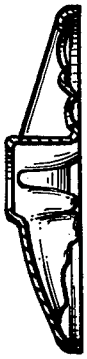
Figure 7:
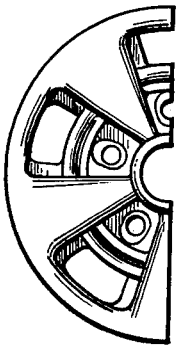
Figure 7A:
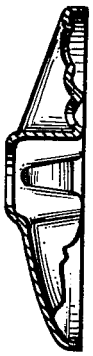
Figure 8A:
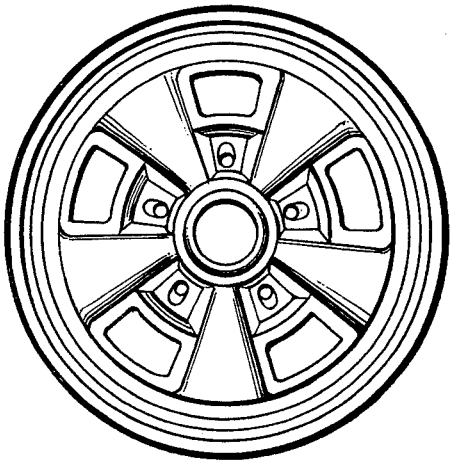
Figure 8B:
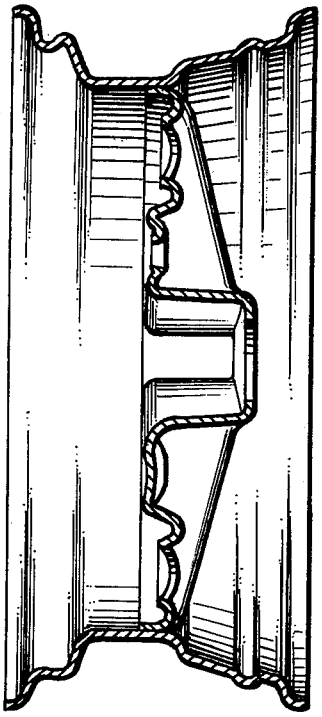

In the figures, FIGS. 1/1*a*–7/7*a* show successive stamping, drawing, and forming steps whereby the wheel center is made. In this sequence of FIGS. 1, 2, etc., show half of the center in top plan view. FIGS. 1*a*, 2*a*, etc., show the corresponding sections. FIG. 8*a* shows a finished wheel comprising rim and center, and FIG. 8*b* shows a section taken along the lines b—b.

Figure 9:
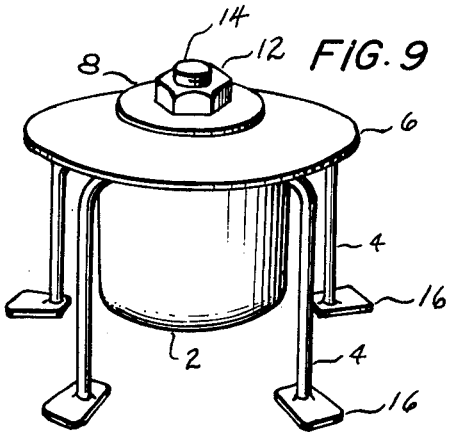
Figure 10:
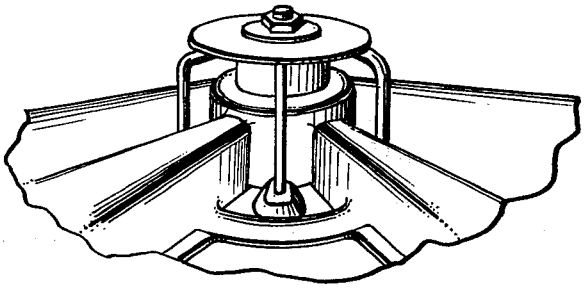

FIG. 9 shows a perspective view of a collector which is used in electroplating. FIG. 10 shows a perspective view of the collector of FIG. 9 mounted in a center ready to carry out the electroplating operation.

Figure 11:
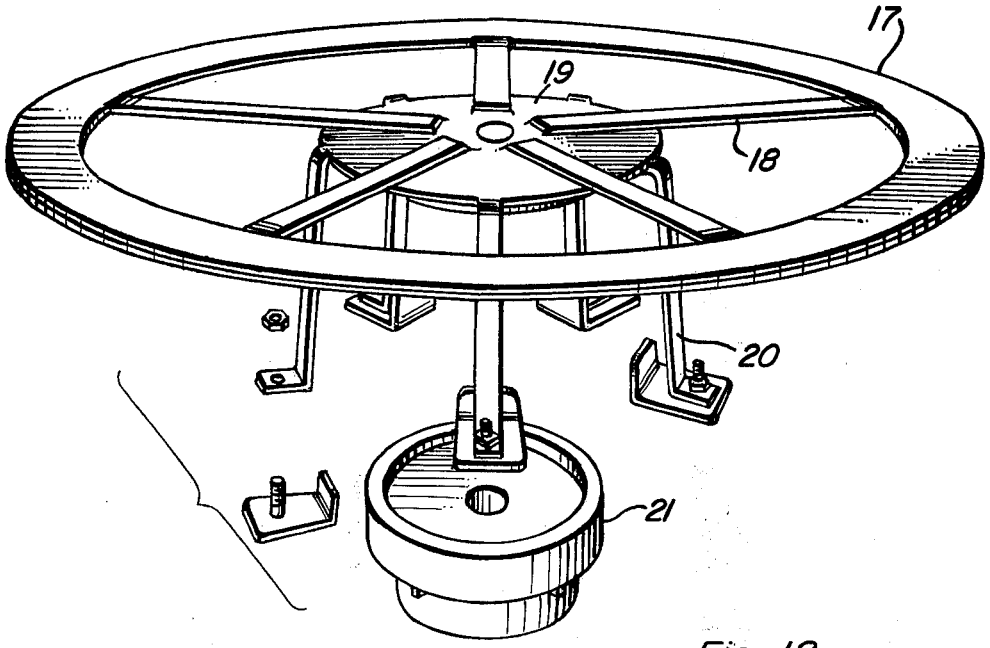
Figure 12:
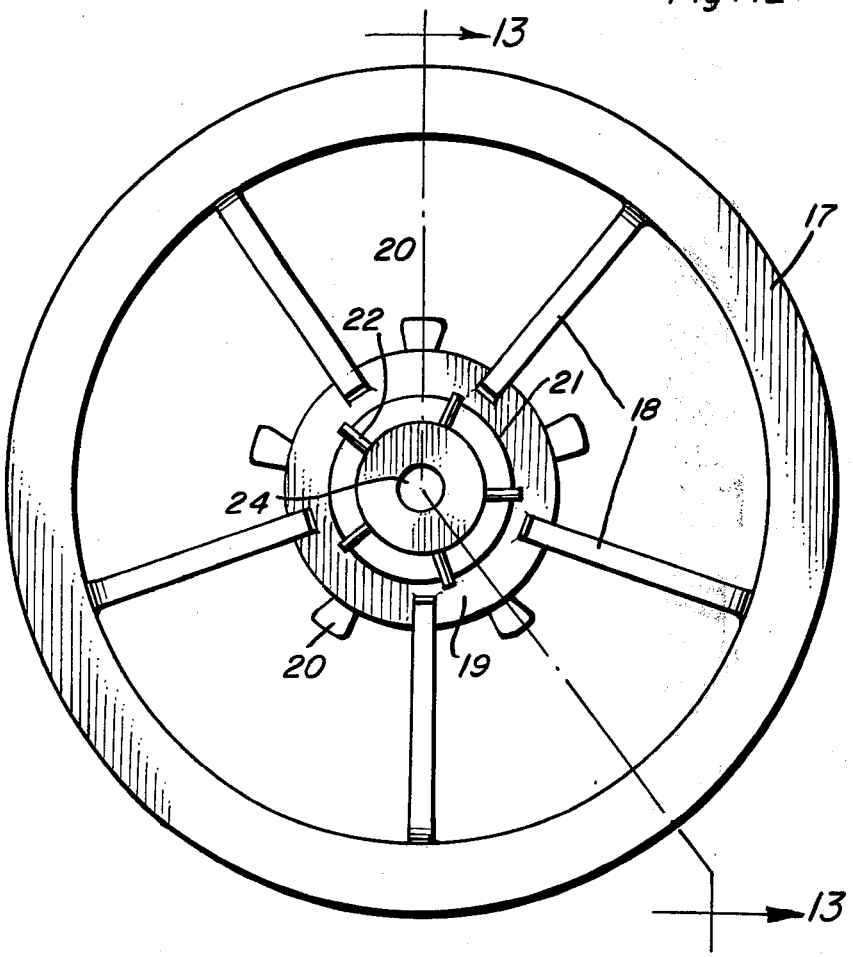
Figure 13:
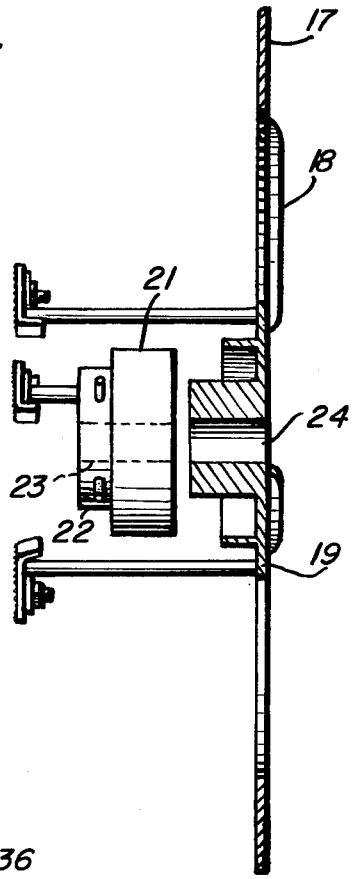
Figure 14:
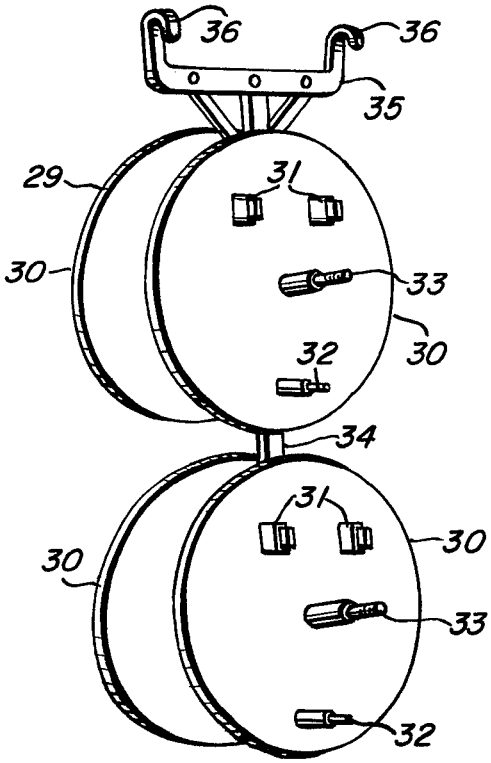
Figure 15:
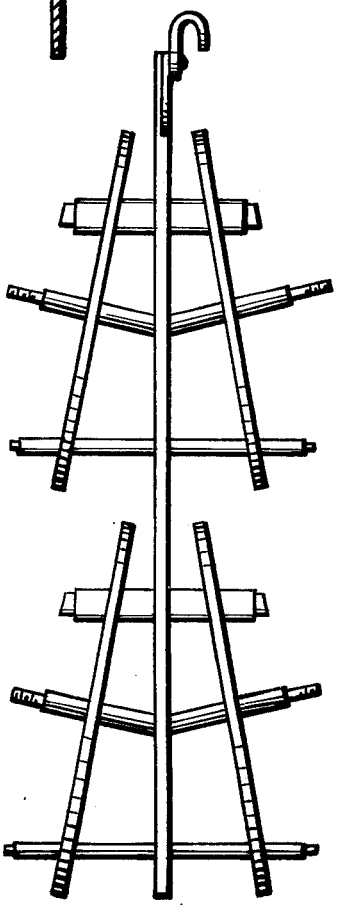
Figure 16:
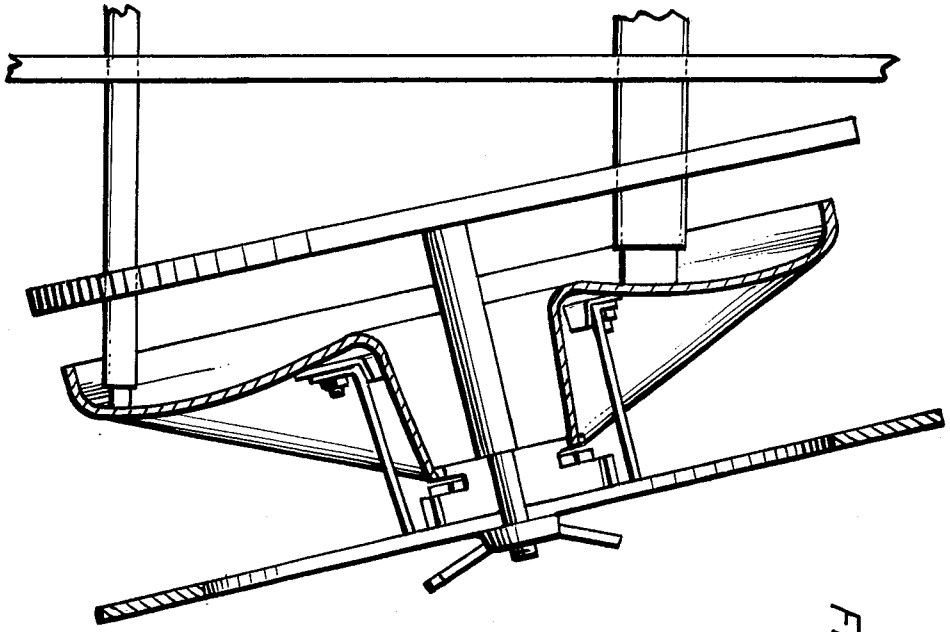
Figure 17:
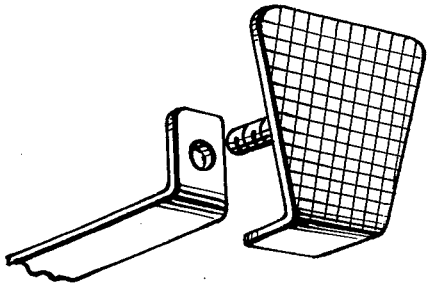

FIG. 11 shows a preferred embodiment of a collector ring (perspective view), and FIG. 12 shows a face view, and FIG. 13 a sectional view taken along 13—13 in FIG. 12. FIG. 14 shows a plating rack in perspective and FIG. 15 in a side view. FIG. 16 shows a wheel center and the collector ring on the plating rack, ready for plating. FIG. 17 shows the bottom of one of the collector ring feet.

STRIP STOCK

The blanks, i.e., the strip stock, were 16 × 96 inches and in thickness 0.168 inches. One such blank makes six wheels. This is a standard type of steel available commercially identified as hot rolled steel, pickled and oiled. The stock material is not critical. For example, aluminum-killed steel, rimmed steel, and draw quality steel are suitable.

PREPOLISHING

Each sheet of stock is polished. This is done preferably by passing each sheet through six different polishing operations. The grinding equipment is conventional. Preferably, six machines are used, one for each of the six polishing operations. Each machine suitably carries a circular polishing belt vertically positioned. The work piece is fed through the machine by means of two sets of duplicate pinch rolls on the incoming side. The leading edge of the work piece proceeds between the polishing belt and a pressure roll. The pressure roll presses the work piece against the polishing belt. Four pinch rolls pick up the work piece as it emerges from the grinding belt and drop it in a stack on a work table. The machine suitably is equipped with a dust collector, since the combination of metal removed from the surface of the work piece and the abrasive material removed from the polishing belt is considerable. When 16 inches -wide stock is used, it is preferred that the dimensions of the polishing belt be 18 inches wide by 126 inches in total length. The belt is, of course, endless. As stated, these finishing operations proceed through six separate steps, one for each of the series of six machines. The first machine uses No. 150 aluminum oxide grit. After all the stock strips of a given piece are passed under the belt of the first machine (approximately 40 strips) the belt is transferred to the second machine and is thus reused on all of the strips once more. A new 150-grit belt is put on the first machine. In the second machine the used belt acts as further finishing means. In the third polishing machine a new belt of No. 220 grit aluminum oxide is used. All the work is passed under this belt for step No. 3. For step No. 4 the same belt (now used) is used once more on the number four machine for all of the work pieces. For step No. 5 a belt using No. 220 grit of silicon carbide is placed on the number five machine. All the stock pieces are passed under this belt for step No. 5. For step No. 6 the used belt from the number five machine is placed on the sixth and last machine, and all of the stock strips are passed under same. Thus six steps and six machines in all are used, but only three grades of polishing belts. New belts are used on the first, third, and fifth machines, and the used belts are transferred respectively to the second, fourth and sixth machines. They are discarded after the latter use.

The stock strips coming off the last belt have a surface which is sufficiently polished to accept nickel electroplating, even after forming, drawing, stamping, etc. as will be hereinafter explained. A finish in the range of about No. 8-16 is suitable. Such finish can, of course, be attained by polishing means other than that described and well known to those skilled in the polishing art. It is the finish that counts, and not how it was obtained.

Polishing machinery is available commercially for the polishing operations. A machine made by the Acme Manufacturing Co. of Detroit can be used.

As has been explained, it is essential for the subsequent nickel and chrome electroplating operations that the stock strips achieve a very fine finish at the outset before any subsequent stamping, etc. operations are commenced. In addition to providing a suitable surface for eventual electroplating, prepolishing also provides immediate benefits in that it removes mill scale and aids in the operation of the die lubricant in operations in the die shop below described.

STAMPING, DRAWING, FORMING, ETC.

The following concerns operations in the die shop.

The first step is to stamp out and draw the "hat" blank as shown in FIG. **1/1-*a***. This is accomplished by a die having the indicated configuration, in a press of, for example, 500 Tons. As noted, this operation gives a blank with a deeply drawn and elevated interior. This area is drawn to an extent far greater than will be necessary in the subsequent finished wheel. The reason for this great depth of draw is that a considerable excess of metal must be provided for the steps hereinafter explained wherein the lug pockets are formed. In overall diameter this piece is about 12.5 inches and in depth about 3¾ inches. The dome of the hat is about 10 inches in diameter.

In step No. 2 (see FIGS. 2/2a) the second die presses down in what will become the 5 lug pockets. In this step the proto-spoke areas are formed as "gathers". This step slightly increases the diameter of the blank, to about 12⅞ inches, while simultaneously reducing the center height, to about 3-3/16 inches. In this operation the beginnings of the lug pockets are formed. Also there may be evident in this step some ripples in the proto-spokes. The lug pocket areas are formed in the same plane with the periphery, and approach the center hub area for about 3¼ before merging into the hub area. The hub or center area itself is about 3 inches in diameter. Providing enough metal to make the lug pockets results in an excess of metal in the spoke and hub areas. Hence in the subsequent steps the forming operations must include compression to reduce this excess metal.

In step No. 3 (see FIGS. **3/3*a*) the third die makes a further indentation into the lug area while at the same time compressing down the hub area and the spoke areas. It would not be possible to make this necessary indentation into the lug areas if it were not possible to compress further the hub area and the spoke areas, since the latter areas are in effect reservoirs of metal needed to make the indentations into the lug areas. At this point it may be noted that if the initial deep drawing for blanks Nos. 1 and 2 had not been carried out, the final deep indentations contemplated for the lug areas in steps 4 and subsequent would not be possible, for the reason that the lug areas otherwise would have been too thin to permit stamping out the lug holes. Step No. 3** gives a blank which is again increased in diameter, e.g., to about 13⅛ inches. The hub area is further compressed, and now has a height of about 2¾ inches. The lug areas further approach the center, and are now slightly below the peripheral plane. The extreme " edge" of the lug area may measure 4½ inches from the periphery to the center.

Continuing with blank No. 4 (see FIGS. **4/4*a*) it will be seen that at this step the wheel has very nearly achieved its final form. The geometry of the wheel has been finalized, except that the lug bosses have not yet been formed nor have the 5 rim slots been stamped, nor the hub hole. The spokes and hub have been brought down to their final height. In this step No. 4** the die turns the peripheral rim down to give a ⅝ inch peripheral depth. This rim may have a ¼ inch straight side. The lug area is now about ½ inch below the annular rim. The center diameter has now been reduced to 12⅜ inch and the center height has been reduced to 2½ inches, i.e., a ratio of substantially 5 to 1.

In some instances, the upper surfaces of the spokes from step 4 may have a slight ripple. If the ripple is present it is barely detectable by touch or eye. It is readily removed by a pressing step, with a die designed particularly for pressing the spoke surfaces, in step No. 5. Pieces Nos. 4 and 5 are substantially the same except for the ripple, if any.

Continuing on to blank No. 6 (see FIGS. **6/6*a*), at this step the lug bosses are created by raising central sections of the lug areas about 5/16 of an inch. This, of course, requires a considerable amount of metal. However, this metal is available by reason of the preceding series of deep draws. These lug bosses have to be formed as a separate operation. This step cannot be combined with the step of forming the final lug recess. In proceeding from blank No. 3, if it is attempted to form simultaneously the ultimate lug recesses and the lug bosses, the metal will be ruptured. In blank No. 6** also the hub hole is stamped out.

In the final step, No. 7, the peripheral (rim) slots and the lug holes are pierced. The lug areas can of course be pierced for holes to fit different size hubs on different cars, for example Chevrolets, Fords, Pontiacs, and the like.

The lug holes may be ⅝ inch at the bottom (facing the car), tapering to ¾ inch at the top. The lug holes are coined and tapered at this step. The lug holes are punched to provide a conical opening. This is desirable in mounting the wheels using conventional lugs, which are of course conical in terminal section. The entrance angle into the lug holes is, of course, adapted to the angle of the lugs intended to be used with the wheels.

After step 7 the wheel can be taken direct to final polishing and plating operations.

Conventional die lubricant is used in all die operations, and the final product from the stamping plant is thus coated with a thin film of die compound. This film is permitted to remain while the center is in storage.

However, prior to the nickel and chromium plating operation this film must be removed. This is customarily done by agitation in a caustic bath followed by a water rinse, and acid bath, and a second water rinse.

Five hundred ton presses in series are suitable for carrying out the forming operations described in this section, except for Step 5, for which a 2000 or 2500-ton press is recommended.

All the above steps are done cold. Hot working is not necessary.

As noted, it is crucial to the entire series of steps following step 1 that metal be made available to the forming operations by compression of already drawn metal. Only in this way can the great height/depth differences in spoke, hub area, and lug area be retained with good structural strength.

ished by hand, etc. This coating of chrome metal is fairly critical and is generally less than 0.0001 inches thick. If it is plated any thicker its appearance would be rather dull, since chromium metal is a gray color in thick layers. If it is any thinner it cannot adequately protect the upper coat of nickel from scratches, etc. The nickel coatings themselves are very carefully controlled. Too much nickel results in a rough surface, and not enough nickel would show scratches and polishing lines from the steps preceding the plating operation. If there is not enough chromium the underplated area would tend to turn yellow very quickly.

As stated, these plating baths are standard. We prefer, however, the following concentrations of salts in the three respective baths, and the amperage as stated.

| | Metal Concentration | Amperage | Time in Bath (Minutes) |
|---|---|---|---|
| First Nickel Bath | 22.2 oz./gal. | 66.5 amps/sq.ft. | 10 min.,21 sec. |
| Second Nickel Bath | 23.3 oz./gal. | " | " |
| Third Nickel Bath | 22.2 oz./gal. | 17 amps/sq.ft. | 3 min.,36 sec. |
| Chromium Bath | 44 oz./gal. | 200 amps/sq.ft. | 2 min.,48 sec. |

SUPPLEMENTAL POLISHING

The wheel center is now put through additional polishing operations prior to plating. These operations comprise roughing and buffing. However, only the spoke and peripheral areas (annular rings) are polished, since these are the only areas that can be reached by the polishing equipment. The lug areas are too deep to be affected. These operations are carried out in order to blend out the die marks on the tops of the spokes and in the peripheral area. The roughing operation on the spokes is suitably done in two steps, the difference being that the first step is done with a medium-grade abrasive and the second is done with a finer abrasive. Both of these steps involve the use of a conventional cloth and emery polishing wheel. A polishing stick consisting of medium-grade tallow and emery is fed into the wheel simultaneously with exposure of the spoke areas to the polishing wheel.

The buffing operation likewise suitably uses two steps. One man can buff the peripheral areas, then can hand the wheel center to the second man who buffs the spoke areas. More buffing area is covered than in the roughing steps.

THE PLATING OPERATION

The electroplating steps are four. The cleaned piece is plated with a first coating of nickel, then a second coating of nickel, then with a third coating of nickel (all distinctly independent operations) and finally with a coating of chromium metal. These electroplating operations are standard in the art. They are used, for example, to plate numerous types of automotive accessories, e.g., bumpers, molding strips, door handles, and the like. The function of each electroplating coating is well known. The first plating of nickel levels the surface of the piece, i.e., pits and scratches are filled in and the surface is generally levelled. The second nickel coating is much brighter and also does some leveling. The third coating of nickel is much thinner but provides very high resistance to corrosion. The coating of chromium metal is added to provide resistance to scratching, such as may result when the car is washed or the wheel is pol- In these plating operations the use of our electrolytic collector is essential. This is described below.

THE ELECTROLYTIC COLLECTOR

The electrolytic collector (see FIG. 9) comprises a plug 2, a plurality of legs 4, a base plate 6, and washers 8 held together by nut 12 and bolt 14. Each of the legs 4 has a foot 16. The legs 4 and the feet 16 are painted to insulate them from the electrolytic bath. However, the bottom of each foot 16 is unpainted and does in fact conduct the electric current. The legs are in electric contact with the metal base plate 6. The feet 16 are preferably formed of titanium metal, and their bottoms are preferably platinum plated. The function of the collector is to attract nickel and chromium ions into the deep lug pockets thereby to provide a coating of metal in these areas as thick as that given to the more accessible spoke and peripheral areas. The material of plug 2 can be plastic (i.e., polvinylchloride) or wood, or the like. The material is not critical so long as it fits into the hub hole and provides good electrical insulation.

In FIG. 10 the collector is shown in position in the polished center, ready to be taken through the nickel and chromium electrolytic plating steps.

An essential consequence of this entire series of steps is that it yields a wheel center which can be adequately plated. No other wheel center made by forming and drawing, so far as is known, can be adequately plated.

To state this another way, the initial polishing operation of the blank above referred to places the ultimate lug pockets in condition for plating. This is crucial, since absent such prepolishing, if these deeply indented lug pockets, in a rough pre-formed condition were plated by the standard technique, the plating would not adequately seal the pores of the metal, and after a few months of service under road conditions, the lug area would show signs of rust.

FIG. 11 shows an improved version of the collector ring, with plug detached, in perspective. This version is substantially larger than the embodiment shown in FIG. 9, and results in a denser and more adherent plating of nickel and chromium on the wheel center. A face view of this collector is shown in FIG. 12. The collector (made basically of steel, except as noted), comprises a ring 17 connected by radially extending spokes 18 to a center base plate 19. Intermediate the spokes 18 are feet 20. The bottoms of these feet are detachable and are preferably platinum plated titanium covered with a gauze of platinum clad tantalum alloy welded onto the base of each foot. This feature is shown best in FIG. 17. The collector assembly includes a detachable electrically insulating plug 21, which is adapted to fit into the circular recess in the base plate 19. This relationship is best shown in FIG. 13, which is a sectional view of the collector of FIG. 12, taken along the line 13—13. FIG. 13 shows the plug 21 slightly separated from the collector ring. Plug 21 includes a plurality of metal pins 22. These pins function to diminish wear on the plug when the wheel center is placed on the plug and thence onto the plating rack as later described. The plug 21 is made of an electrically non-conducting material, such as polyvinyl chloride (PVC), and is provided with a center hole 23 which aligns with a corresponding center hole 24 in the center base plate 19.

In conducting the plating operation, a plating rack such as that shown generally at 29 in FIG. 14 is used. Four wheel centers can be mounted on this plating rack. The rack comprises a plurality of supports 30. Each support comprises upper contacts 31 and a lower contact 32. These contacts are actually metal bars which extend through supports 30 and are welded thereto. Each support contains a center bolt 33 for mounting the wheel center (to be plated) plus collector ring and plug. The assembly of supports 30 and contacts 31 and 32 is mounted on vertical shaft 34 which is attached to hook assembly 35. The entire support 29 is coated with a PVC plastisol to render it electrically nonconducting except for certain limited exposed areas. These areas are the tips of connecting bars 31 and 32. The wheel center is tightened into good electrical contact against these points, where the metal is exposed. Also the hooks 36 are also bare metal, to provide good electrical contact when the rack is hung on the plating supports in the plating bath.

FIG. 16 shows an enlarged side elevation of the rack of FIG. 14. FIG. 16 shows a wheel center mounted on one support 30, preparatory to plating. This figure shows the wheel center 40 pressed against the outer bare metal edges of contacts 31 and 32. Plug 21 supports wheel center 40 through the upper hole. The plug 21 makes contact with the wheel center 40 at the metal pins 22. These prevent excessive wear of the plug. The plug 21 fits on bolt 33. The collector ring slips over the bolt 33 and nests into plug 21. Then plastic-coated butterfly nut 41 is placed on bolt 33 and tightens up the total assembly. The wheel center is now ready for being processed in the plating baths. It will be in direct electrical contact with the cathode in the plating baths. That is, the collector ring will carry a negative charge and the plating liquid will be positively charged with respect to the ring.

Referring again to FIGS. 11, 12 and 13, the collector ring 17 can be coated with plastic as follows. First, the ring (not including the plug 21) is coated with a primer (except in areas to be left bare, i.e., top of the ring and bottoms of the feet), and then is heated, e.g., to 325 ° F. The hot ring is dipped into an insulating material, e.g., PVC plastisol; then it is withdrawn, drained, and allowed to cure. PVC will not adhere to unprimed surfaces, and hence these areas should emerge with the bare metal exposed. If coated, however, the surfaces can be cleaned where necessary to remove any unwanted PVC.

After the collector ring has been in use for several plating cycles the bare upper surface of the ring will pick up a plating of mixed chrome and nickel. This will not interfere with the plating operation. Also, the pins 22 will acquire a harmless excrescence of plating metal. The same coating technique can be used with the plating rack 29.

The collector ring above described is specifically designed for plating a 5-spoke wheel center, as shown in FIGS. 1–8. However, the same concept is readily adaptable to plating wheel centers having four spokes or more than five spokes. The number of feet 20 would, of course, have to be changed to match the number of lug receptacles concerned. Also the plating rack 29 would have to be modified so that the connecting points 31 and 32 would make good electrical contact with the modified wheel center. For example, with a 4-spoke wheel, two supports 32 would be used to give symmetrical support to the wheel center.

The collector ring as shown in FIGS. 11–13 is 13 inches o.d., and the outer ring itself is 1⅛ inches wide. The wheel center in this instance is about 12⅛ inches. Thus the ring is slightly greater in diameter than the wheel center that it is used to plate. Using a collector of greater diameter than the wheel center appears to give superior results. Thus, we have found the collector of FIG. 11 to be better than the collector of FIG. 9 when used with the same size wheel center.

Although all the description herein refers to a 5-spoke wheel, this is obviously not critical. It can be used also to make a 4-spoke wheel, for example, Pinto, many foreign imports, and the like. Additionally in the larger categories the same technique can be used to make a 6-spoke wheel.

The final step of welding the center into the wheel rim is also standard, and equipment and procedures for accomplishing this are conventional in the art. It may be stated in general that the waiting rim has already been plated. The plated center (prepared by the process of this invention) is pressed into the plated rim, is aligned, and then it is welded using a short arc. This gives the final wheel ready for installation on the automobile.

What is claimed is:

1. A collector for use in plating wheel centers comprising an insulating plug, and metal base, a plurality of metal legs between said base and the upper face of said plug, foot plates on each of said legs, said plug being connectable to said base plate.

2. Apparatus according to claim 1 in which the foot plates are titanium metal, platinum plated on their bottoms.

3. Apparatus according to claim 1 in which the foot plates are platinum plated and carry a gauze of platinumiridium on their bottoms.

4. Apparatus according to claim 1 in which the collector comprises a ring, attached to the base by radial arms.

5. Apparatus according to claim 4 in which the ring is of larger diameter than the wheel center to be plated.

6. Apparatus according to claim 5 in which the plug is detachable from and nests into the base plate.

* * * * *